United States Patent [19]

Erickson

[11] Patent Number: 4,817,394

[45] Date of Patent: Apr. 4, 1989

[54] OPTIMIZED INTERMEDIATE HEIGHT REFLUX FOR MULTIPRESSURE AIR DISTILLATION

[76] Inventor: Donald C. Erickson, 1704 S. Harbor Ln., Annapolis, Md. 21401

[21] Appl. No.: 151,565

[22] Filed: Feb. 2, 1988

[51] Int. Cl.[4] ..... F25J 3/04

[52] U.S. Cl. ..... 62/22; 62/31; 62/34; 62/38

[58] Field of Search ..... 62/9, 11, 22, 23, 24, 62/27, 28, 31, 32, 34, 38, 41, 42, 44

[56] References Cited

U.S. PATENT DOCUMENTS 4,137,056 1/1979 Golouke ..... 62/22 X
4,605,427 8/1986 Erickson ..... 62/22
4,670,031 6/1987 Erickson ..... 62/22
4,737,177 4/1988 Erickson ..... 62/22

*Primary Examiner*—Steven E. Warner

[57] ABSTRACT

The invention discloses process and apparatus for separating high purity oxygen and crude argon from air by fractional distillation. The improvement, which applies to both dual pressure and triple pressure configurations, entails maximizing the distillation efficiency of both the HP rectifier (2 of FIG. 1) and the LP $N_2$ rectifier (1*a* and 1*b*) by feeding precisely correct quantities of liquid air reflux to each via respective valves (6) and (8). In order to efficiently produce the required amount of liquid air, liquid oxygen at least 0.2 ATA above LP column pressure is evaporated by two air condensers: a total condenser (22) and a partial condenser (23).

22 Claims, 6 Drawing Sheets

OPTIMIZED INTERMEDIATE HEIGHT REFLUX FOR MULTIPRESSURE AIR DISTILLATION

DESCRIPTION

Technical Field

This invention relates to processes and apparatus for the fractional distillation of air to high purity oxygen and crude argon, and optionally also nitrogen coproduct. The described improvement results in increased efficiency of the distillation steps, and that improvement in turn makes possible several advantageous results, including higher recovery of $O_2$, argon, or coproduct $N_2$, and/or higher production pressure of $O_2$ and/or $N_2$, all without increase in energy supply. Both high purity oxygen (nominal purity 99.5%) and crude argon (nominal purity 95%) are important items of industrial commerce, used in steel-making, metal-working and for many other purposes, and consumed in quantities on the order of millions of ton per year.

Background Art

There are two basic approaches to the fractional distillative production of the above gases: dual pressure distillation and triple pressure distillation. They share many commonalities: in both approaches a high pressure rectifier is cascaded with a low pressure argon-oxygen distillation column comprised of argon stripper and argon rectifier; and a low pressure $N_2$ removal column is fed HP rectifier bottom liquid, refluxed by HP rectifier overhead liquid, and yields the oxygen-argon mixture which is further separated to crude argon and high purity oxygen in the argon stripper and rectifier.

The primary differences between the two approaches are: with dual pressure, the $N_2$ removal column, at the same pressure as the argon column, is connected at the bottom directly to the feed point of the argon column, in direct vapor-liquid communication. In this configuration, the argon rectifier is frequently referred to as a "sidearm". With triple pressure distillation, the $N_2$ removal column, at a slightly higher pressure than the argon column, is connected at the bottom to a second argon stripper, which is reboiled by direct condensation (either partial or total) of part of the supply air, and the liquid oxygen-argon feed to the argon column is obtained from the connecting point between the $N_2$ removal column and the second argon stripper. Thus, with triple pressure, both argon strippers yield product-quality bottom liquid oxygen.

Prior art examples of the dual pressure approach include U.S. Pats. Nos. 4,670,031, 2,934,908, 3,751,993, 3,729,943, and 4,715,874. Prior art examples of the triple pressure approach include U.S. Pats. Nos. 3,688,513, 4,137,056, 4,507,134, and 4,578,095.

Problems with the disclosed prior art practice of multipressure distillative production of high purity oxygen include the following. The overall goals for both approaches are the same: first, to make $O_2$ of the required purity without any additional power input than that necessitated to introduce supply air to the HP rectifier (which is at a lower pressure with triple pressure than dual pressure--e.g., 4 ATA vice 5 ATA); and subsequently, to maximize the recovery of $O_2$ and pressure of $O_2$; usually to also maximize crude argon recovery; and frequently to also maximize recovery and pressure of coproduct $N_2$. In addition to avoiding additional power input, it is also desired to avoid significant increases in capital cost.

Unfortunately, most of these objectives have heretofore proved elusive. The one exception is increased argon recover--the U.S. Pat. Nos. 4,670,037 and 4,715,874 disclose methods for increasing argon recovery in dual pressure plants without offsetting decreases in $O_2$ yield, and the U.S. Pat. No. 4,578,095 does the same for triple pressure plants.

Historically, product oxygen has been evaporated by exchanging latent heat with HP rectifier overhead $N_2$. This establishes the $O_2$ pressure at a relatively low value, thus adding too both the capital cost and energy cost of any subsequent $O_2$ compression. There has been much interest in increasing the $O_2$ evaporation pressure, by evaporating it by exchanging latent heat directly with supply air, either at its bubble point (total condensation) or near its viewpoint (partial condensation). The bubble point temperature of air is about 2 K higher than the condensation temperature of $N_2$ at the same pressure, and the dewpoint temperature is some 4 K higher. Unfortunately, in high purity plants, which require a great deal of reboil and reflux through the argon stripper and argon rectifier, when air is used to evaporate liquid oxygen directly and not via the HP rectifier, much less $LN_2$ is thereby available for refluxing. The net result is that with PC LOXBOIL (partial condensation liquid oxygen evaporation), the $O_2$ recovery suffers severely, more than offsetting the increase in $pO_2$ obtained thereby. This problem can be avoided with TC LOXBOIL, only providing that the liquid air from the total condensation is split and routed to intermediate reflux heights of both the HP rectifier and the $N_2$ removal column. Even though this restores full $O_2$ recovery and provides some increase in $pO_2$, it still has the disadvantages that it so decreases the available $LN_2$ that the capability of producing high pressure $N_2$ coproduct almost disappears, and also the $pO_2$ increase is much smaller than with PC LOXBOIL.

What is needed, and one objective of this invention, is a method and/or apparatus for producing high purity oxygen and crude argon which produces the oxygen at pressures characteristic of PC LOXBOIL, without any offsetting decreases in $O_2$ yield, and which furthermore permits, when desired, the co-production of a significant amount of pressurized $N_2$, on the order of 2 to 3% or more (up to 15%).

DISCLOSURE OF INVENTION

Process and corresponding apparatus are disclosed for the fractional distillation of a supply of compressed and cleaned air to high purity oxygen and crude argon comprising:

(a) distilling an oxygen-argon mixture to liquid oxygen bottom product and crude argon overhead product in an argon-oxygen distillation column comprised of an argon stripper and an argon rectifier;

(b) pressurizing said liquid oxygen bottom product to at least about 0.2 ATA above argon stripper bottom pressure;

(c) evaporating at least part of said pressurized liquid oxygen by exchanging latent heat with a major fraction of said supply air which is partially condensed thereby;

(d) withdrawing at least part of said evaporated oxygen as product;

(e) supplying at least the uncondensed fraction of the air from said oxygen evaporator to a high pressure (HP)

rectifier, and rectifying it therein to $N_2$ overhead product and oxygen-enriched bottom product;

(f) refluxing the overhead of said HP rectifier and reboiling the bottom of said argon stripper by exchanging latent heat;

(g) refluxing the overhead of a nitrogen ($N_2$) removal column for distilling said HP rectifier bottom product to oxygen-argon mixture, at least part of which is supplied to said distilling step a), by supplying it with depressurized liquid $N_2$ from the overhead of said HP rectifier;

(h) evaporating additional liquid oxygen in a second oxygen evaporator by exchanging latent heat with about 10 to 20% of said supply air and thereby producing liquid air; and (i) splitting said liquid air into respective intermediate height reflux streams for both said HP rectifier and said $N_2$ removal column.

Only some 10 to 20% of the supply air is totally condensed, and then it is split into two intermediate reflux streams. That is the key to making possible the accompanying PC LOXBOIL step. The overall objective is to achieve near-equilibrium conditions in both the HP rectifier and the $N_2$ removal column at three different locations each: the overhead, the intermediate reflux height, and the feed height. Near-equilibrium signifies a close approach between operating and equilibrium lines, also known as a "pinch", as evidenced ;by closely matching liquid compositions on adjacent trays or stages (e.g., within about 1% of each other).

The key to achieving that close approach at three separate heights is to have precisely the proper amount of liquid air intermediate reflux supplied to each column. Each requires between about 5 to 10% of the total supply air, and hence the total demand is for between 10 and 20% of the supply air in liquid form. The amount is critical--supplying too much liquid air intermediate reflux to a column is as bad or worse than supplying too little. When the proper amount in the above range is supplied to each column, the total requirements for $LN_2$ are minimized. This makes PC LOXBOIL possible in triple pressure plants, in amounts even greater than the product $O_2$ flowrate, so that some can also be used for reboil (thus limiting TC reboil to the required optimal amount). In dual pressure plants, producing product by a combination of PC LOXBOIL and (preferably companded) TC LOXBOIL in the required optimal amount makes available substantial amounts of pressurized $N_2$, either as coproduct or to power a larger refrigeration expander for more liquid production.

BEST MODE FOR CARRYING OUT THE INVENTION

Figure 1:
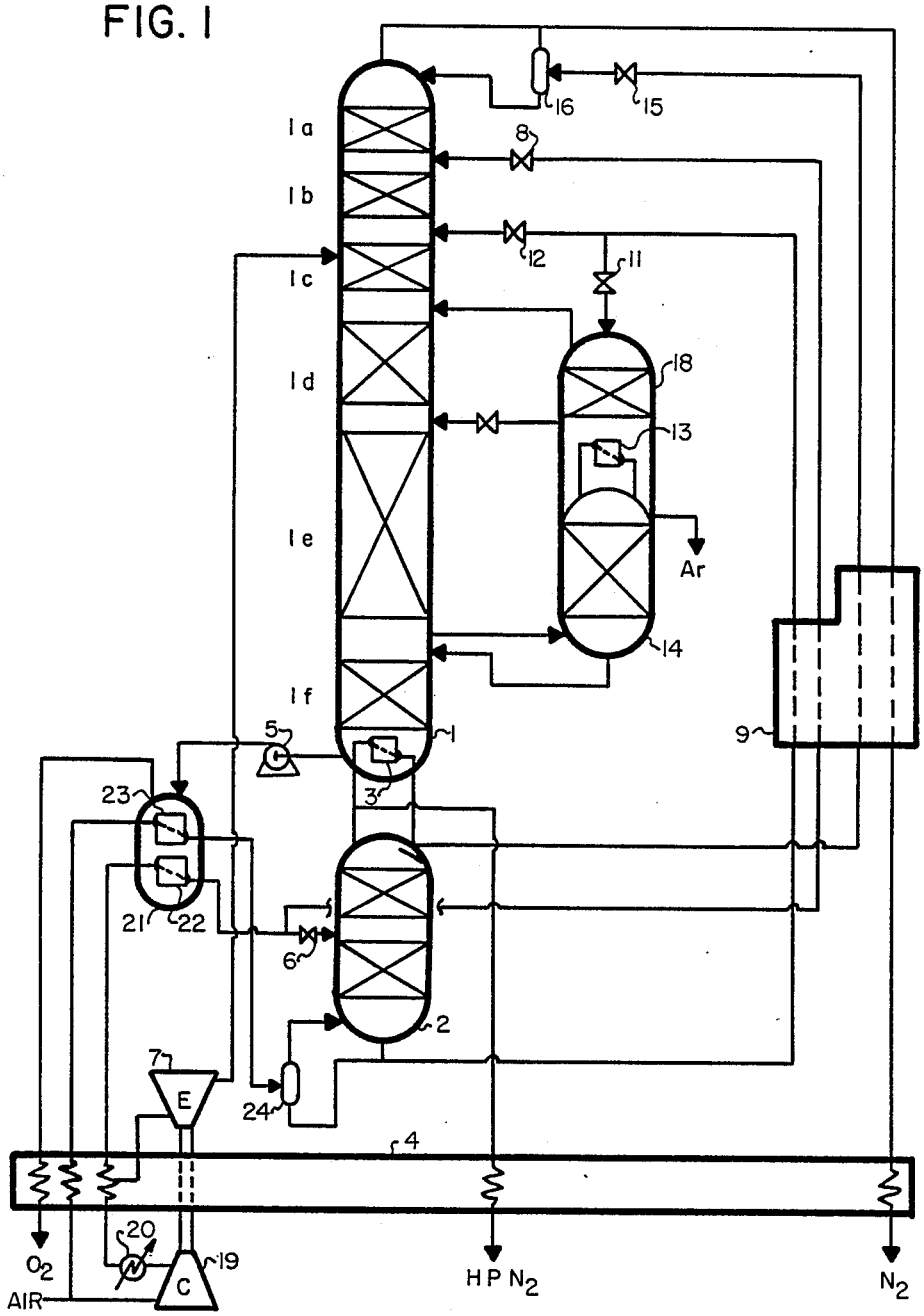
FIGS. 1 through 3 are simplified schematic flowsheet illustrations of preferred embodiments of the invention as applied to dual pressure configurations, and FIGS. 4 through 6 for triple pressure configurations.

Referring to FIG. 1, composite low pressure distillation column 1 is comprised of argon stripping section 1*f*, argon rectifying section 14 (the argon "sidearm"); and $N_2$ removal column comprised of rectifying section 1*a*, stripping section 1*e*, and additional zones of counter-current vapor-liquid contact in the central section of the column, sections 1*b*, 1*c*, and 1*d*. The argon column (stripper 1*f* and rectifier 14) and $N_2$ removal column are connected in vapor-liquid communication at the junction point between sections 1*e* and 1*f*. HP rectifier 2 provides overhead $N_2$ vapor to reboiler/reflux condenser 3, which reboils the bottom of column 1 and yields liquid $N_2$ for refluxing the overhead of both HP rectifier 2 and $N_2$ rectifier 1*a*.

Supply air, after compression to about 5.5 ATA (atmospheres absolute) and cleaning of $H_2O$, $CO_2$, and other impurities, is split and the majority is cooled in main heat exchanger 4 to near the dewpoint and supplied to partial condenser 23, which is one part of liquid oxygen evaporator 21. The remaining 20 to 30% of the supply air is additionally compressed in warm (ambient temperature) compressor 19, optionally cooled in ambient cooler 20, and then also cooled to near the dewpoint. The additionally compressed supply air, which is at least about 0.5 ATA higher in pressure than the supply air, is then split again. Ten to 20% is essentially totally condensed to liquid air in total condenser 22, which also evaporates liquid oxygen in evaporator 21. THe liquid air is split into two intermediate height reflux streams, one for HP rectifier 2 via valve 6 and the other for $N_2$ removal column 1a through 1e via valve 8, preferably after subcooling in subcooler 9.

At least the unevaporated portion of the partially condensed air from condenser 23 is fed to HP rectifier 2; optional phase separator 24 may be used to separate out the liquid fraction, which is combined with the oxygen-enriched bottom liquid (kettle liquid) from rectifier 2 and then fed to column 1, preferably having been partially evaporated first. Most preferably, the kettle liquid is cooled in cooler 9, then split with part fed to column 1 as liquid via valve 12, and the remainder supplied to the means for overhead refluxing of sidearm 14 via valve 11.

The means for refluxing the overhead of argon rectifier 14 is comprised of overhead reflux condenser 13, plus a zone of counter-current vapor-liquid contact 18 (approximately one theoretical stage) having vapor withdrawal points both above and below the contractor. The two vapor streams are of differing composition, the lower one being at least about 3% higher in $O_2$ than the upper one. For example, the upper vapor may have 70 to 75% $N_2$ whereas the lower may be 55 to 60% $N_2$, i.e., of lower $N_2$ content than the kettle liquid. The two vapor streams, each of which may optionally also contain some liquid, are fed to different feed heights of column 1: the upper to between contact zones 1*c* and 1*d*, and the lower to between contact zones 1*d* and 1*e*.

Overhead $N_2$ from HP rectifier 2 is condensed to $LN_2$ in condenser 3, and is then slit into two overhead reflux streams as in conventional practice. The overhead reflux stream for column 1 is cooled in cooler 9, expanded or depressurized in valve 15, and optionally phase-separated in phase separator 16. A small part of the HP rectifier $N_2$, up to about 4% of the supply air flowrate, may be withdrawn as vapor coproduct. Crude argon is withdrawn from the overhead of sidearm 14, either as vapor or liquid.

The liquid oxygen bottom product from argon stripper 1f, at product quality (about 99.5% pure), and at column pressure (about 1.35 ATA), is pressurized by at least about 0.2 ATA, and preferably to about 2 ATA, in means for pressurization 5. The latter may be a mechanical pump or simply a barometric leg of liquid of appropriate height. The pressurized liquid oxygen is supplied to LOX evaporator 21, where the two air condensers 22 and 23 evaporate it to product vapor, which is withdrawn.

The refrigeration necessary for the process is derived by work expanding the remaining fraction of the additionally compressed air (amounting to approximately 10% of the total supply air) to column 1 pressure in expander 7, and then feeding it to column 1, at approximately the same height as the kettle liquid feed through valve 12. Cold expander 7 work output is preferably used to power warm compressor 19.

Figure 2:
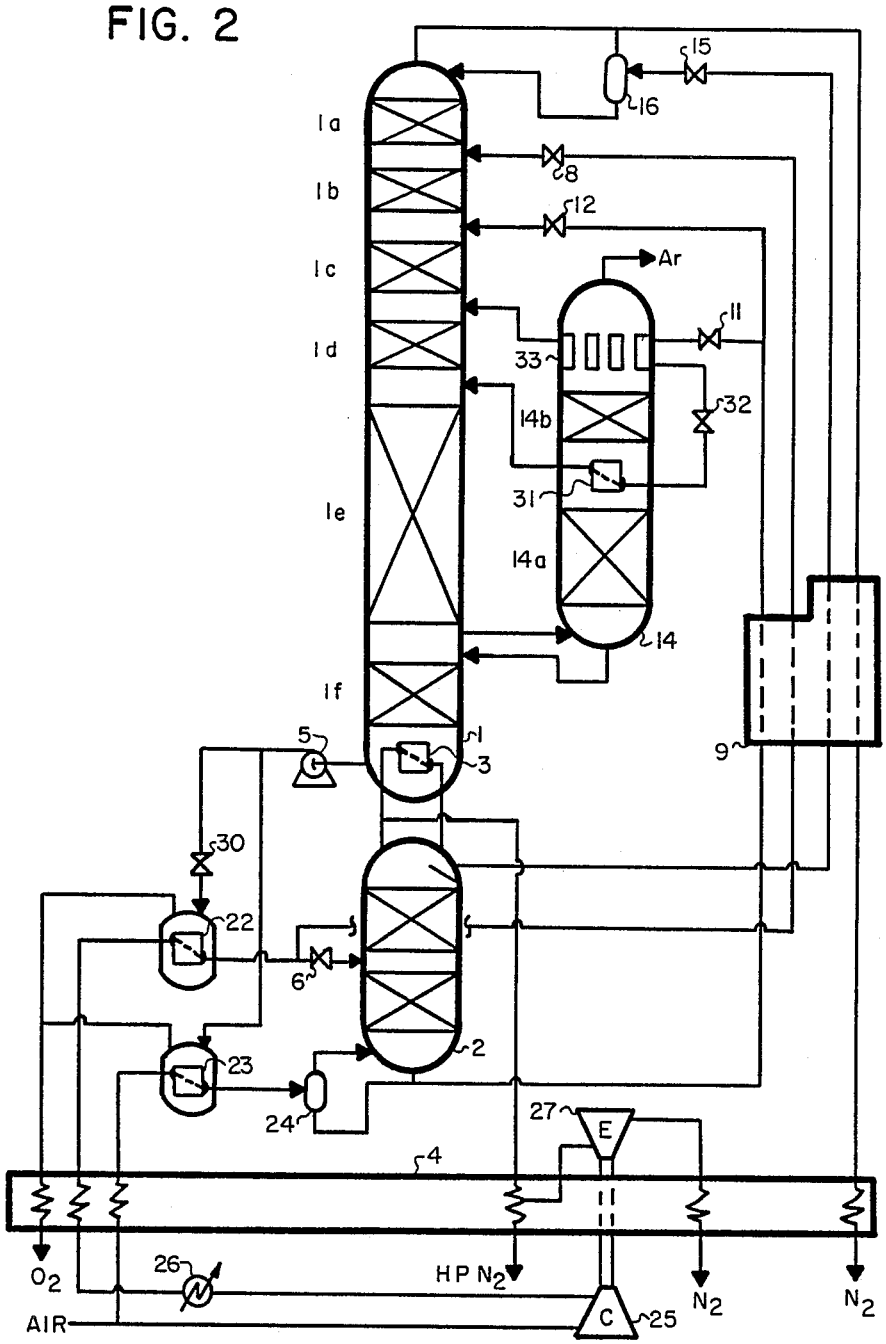
Figure 3:
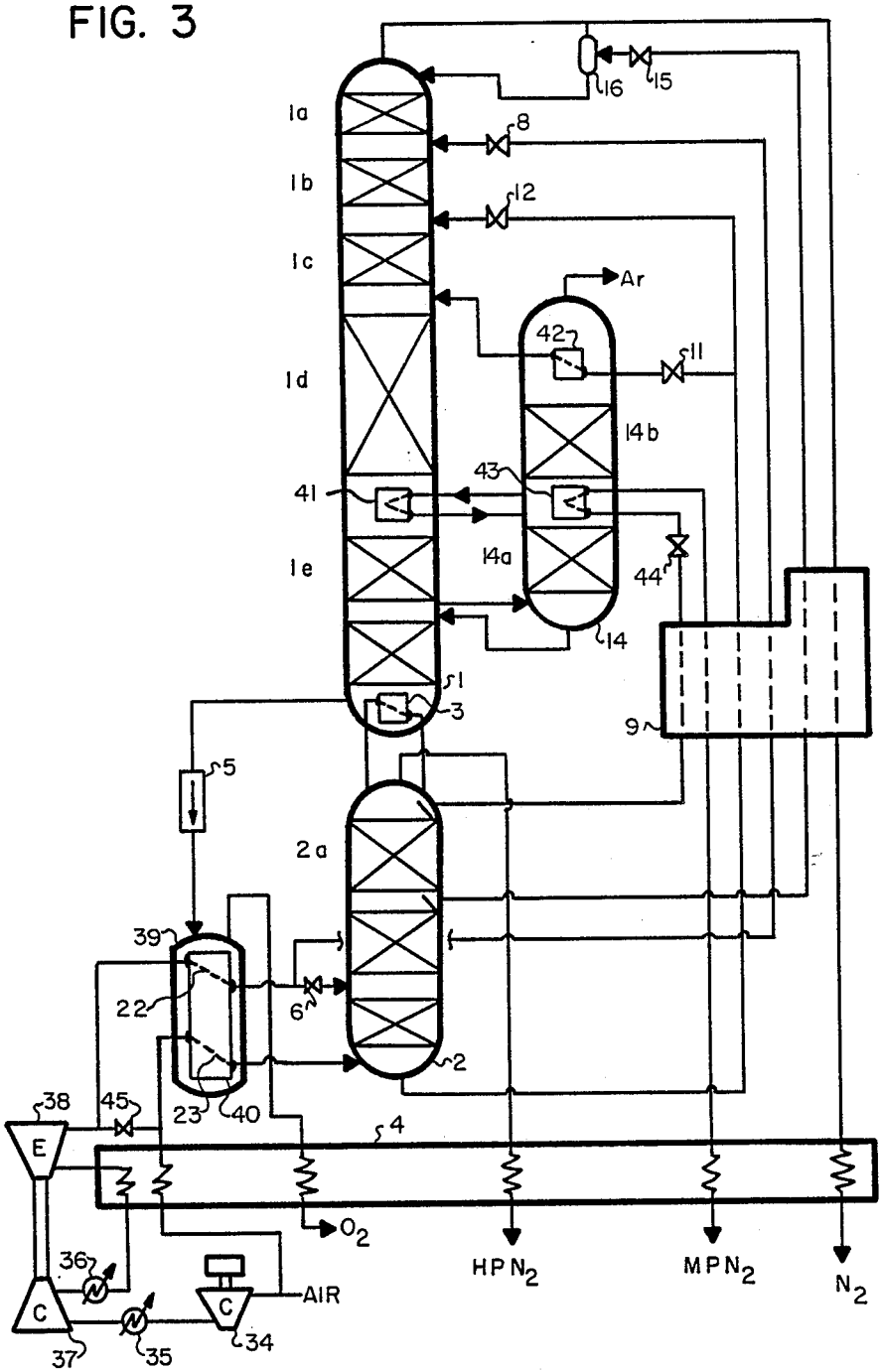

The essential aspects of the invention include the three LOX evaporations: at column 1 pressure by rectifier 2 $N_2$ i reboiler 3; and at higher pressure in condensers 22 and 23; plus splitting the 10 to 20% liquid air from condenser 22 into two intermediate reflux streams for column 1 and rectifier 2 via valves 6 and 8. Other details, such as how argon rectifier 14 is refluxed, or how refrigeration is developed, or whether additional compression is present, are at the process designer's option depending upon the requirements of the particular installation. FIGS. 2 and 3 illustrate other advantageous variations of those details.

Referring to FIG. 2, components 1 through 6, 8, 9, 11, 12, 13, 15, and 16 have the same description as for FIG. 1, and the remaining components describe the differences from FIG. 1. Argon rectifier 14 is refluxed at the overhead by condenser 33, and at an intermediate height (between contact zones 14*a* and 14*b*) by intermediate reflux condenser 31. Condenser 31 is supplied liquid from condenser 33 via valve 32, said liquid being richer in $O_2$ than the kettle liquid, since it was partially evaporated in condenser 33. Since condenser 31 is at a warmer location in rectifier 14 than the overhead, the vapor generated in condenser 31 by latent heat exchange can have a higher $O_2$ content than is possible from the overhead condenser. This permits reduced reboil through contact zone 1e and increased reboil through zone 14*a*, which leads to increased recovery of crude argon.

Process refrigeration for FIG. 2 is via $N_2$ expansion in 27 vice air expansion. Warm compressor 25 thus only compresses the total condensation air enroute to condenser 22. The exhaust $N_2$ streams from expander 27 and column 1 may be withdrawn separately as shown or may be combined. Air condensers 22 and 23 may be provided with separate enclosures as shown, with the liquid air supply divided appropriately between them, e.g., by valve 30. In dual pressure plants, very approximately 40 to 70% of the product $O_2$ is evaporated by condenser 22 ($O_2$ of 7.5 to 15% of supply air flowrate, preferably about 11%); and the remainder in partial condenser 23.

Referring to FIG. 3, the basic inventive entity is described in still another dual pressure context. Argon rectifier 14 has three reflux condensers: overhead condenser 42, cooled by kettle liquid; intermediate reflux condenser 43, cooled by evaporating $LN_2$ from HP rectifier 2 which has been partially depressurized (to about 3 ATA) by valve 44; and also intermediate refluxer 41, which provides intermediate reboil to column 1 by exchanging latent heat with column 1 intermediate reboil height liquid.

Process refrigeration for FIG. 3 is generated in a manner which allows the coproduction of about 15% high purity pressurized $N_2$-either at rectifier pressure (about 5 ATA) or, when high argon production is also desired, at condenser 43 pressure (about 3 ATA), or even a combination of both pressures. In order to coproduce that much $N_2$ at pressure, the refrigeration expander 38 leaves the expansion air at supply pressure. The fraction of air to be additionally compressed is compressed well above HP rectifier 2 pressure, by externally powered boost compressor 34, and preferably also by warm compressor 37. The latter may be either in series with compressor 34 as shown or in parallel. Optional coolers 35 and 36 may also be present. The additionally compressed air is then cooled and work expanded in expander 38. If any additional air beyond the 10 to 20% required in condenser 22 is expanded, it is combined with the partial condensation air via valve 45. Other optional features of FIG. 3 include an extra zone of counter-current vapor-=liquid contact 2*a* in rectifier 2, which upgrades the $N_2$ coproduct to much higher purity than the purity of the $LN_2$ reflux to valve 15; and also the combining of condensers 22 and 23 into a single core 40, in LOX evaporator 39, instead of physically separate condensers.

It will be understood that the argon reflux options illustrated in FIGS. 1 through 3, plus obvious variations thereof, can be selected independently of the refrigeration options plus obvious variations thereof. For example, the liquid $N_2$ cooled intermediate refluxer 43 of FIG. 3 could be incorporated in any other dual pressure flowsheet, to increase argon recovery at the expense of decreased $N_2$ pressure. The figures are illustrative only, and not intended to be limiting. This also applies to FIGS. 4 through 6, which illustrate triple pressure embodiments of the basic inventive entity.

Figure 4:
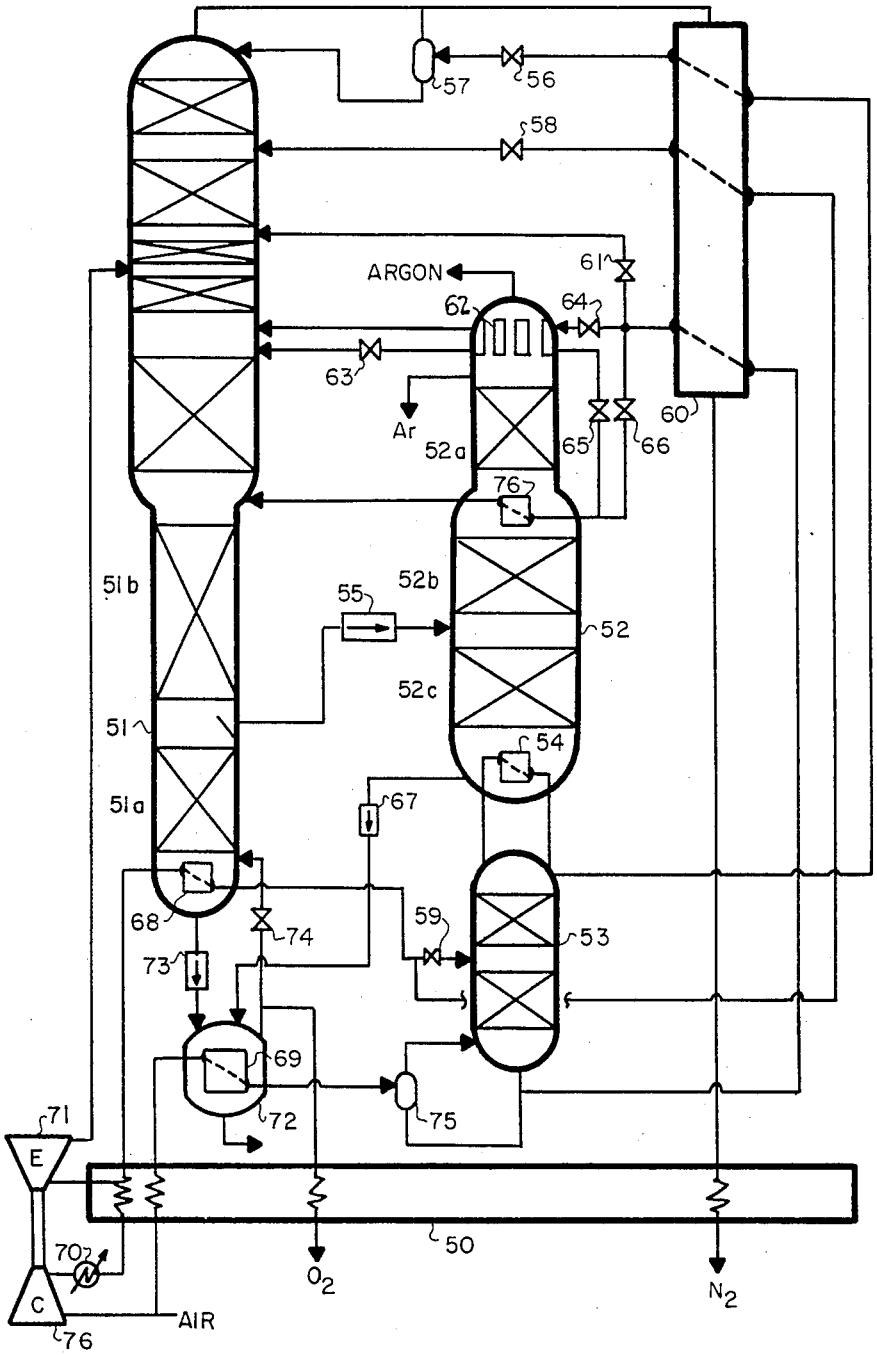

Referring to FIG. 4, at least a major fraction of the compressed and cleaned supply air is cooled to near its dewpoint in main exchanger 50 and routed to LOX evaporator 72, comprised of partial condenser 69. After phase separation in separator 75, at least the vapor component of the partially condensed air is fed to HP rectifier 53, for rectification to overhead $N_2$ and bottom liquid. Reboiler/reflux condenser 54 exchanges latent heat from rectifier 53 to argon distillation column 52, comprised of rectifying section 52*a*, stripping section 52*c*, and mid-section 52*b* of countercurrent vapor-liquid contact. Bottom liquid from rectifier 53 and separator 75 is fed to $N_2$ removal column 51, preferably after evaporation of part of it. The kettle liquid is subcooled in cooler 60, partly fed as liquid to column 1 via valve 61, and the remainder is used to indirectly reflux column 52 before feeding to column 51. Valve 64 routes part of the kettle liquid to overhead reflux condenser 62. Unevaporated liquid from condenser 62 is routed to intermediate height reflux condenser 76. The quantity of liquid to condenser 76 is regulated by valve 63, and the composition of the liquid by valve 66. As with dual pressure plants, the intermediate reflux condenser 76 yields a vapor feed to the $N_2$ removal column which has substantially lower $N_2$ content than does the kettle liquid. This is key to the feasibility of triple pressure configurations, as otherwise the required reboil rate through sections 51*b* and 51*a* would be too large, and full $O_2$ recovery would not be possible. Column 51 has argon stripper 51*a* appended to the bottom of $N_2$ stripping section 51*b*. Liquid oxygen-argon mixture from between the two sections, containing some 4 to 8% argon and less than 0.1% $N_2$, is fed to column 52 via means for transport 55 (e.g., a check valve, control valve, conduit, or pump). Column 52 is about $\frac{1}{3}$ to $\frac{1}{2}$ ATA lower in pressure than column 51, which is at about 1.35 ATA. Product quality bottom liquid oxygen is obtained from both column 52 and 51 in the approximate proportion of the reboil to the two stripping sections, i.e., in approximately 2 to 1 ratio. The liquid from column 52 is pressurized to at least column 51 pressure in means for pressurization 67, and is routed to LOX (liquid oxygen) evaporator 72. Partial condenser 69 evaporates the LOX from component 67, and also column 51 LOX from means for transport 73. Part of the LOX from component 73, typically about 4% of the supply air flowrate is returned to column 51 as reboil via valve 74, and the remainder is withdrawn as product.

The refrigeration option illustrated for FIG. 4 is similar to that of FIG. 1—a minor fraction of the air (about 25 to 30%) is additionally compressed in warm compressor 76, cooled in ambient cooler 70, then partially cooled to near the dewpoint and divided. Part is work expanded to column 51 pressure and fed thereto, while the remainder (10 to 20% of the supply air) is further cooled and then essentially totally condensed to liquid air in condenser 68. Condenser 68 supplies part of the reboil requirement of column 51, with the remainder from valve 74. Column 51 overhead reflux $LN_2$ is withdrawn from rectifier 53, cooled in cooler 60, expanded by valve 56, and separated in separator 57. Liquid air from condenser 68 is divided into two intermediate reflux streams, one to rectifier 53 via valve 59, and the other to column 51 via valve 58.

Figure 5:
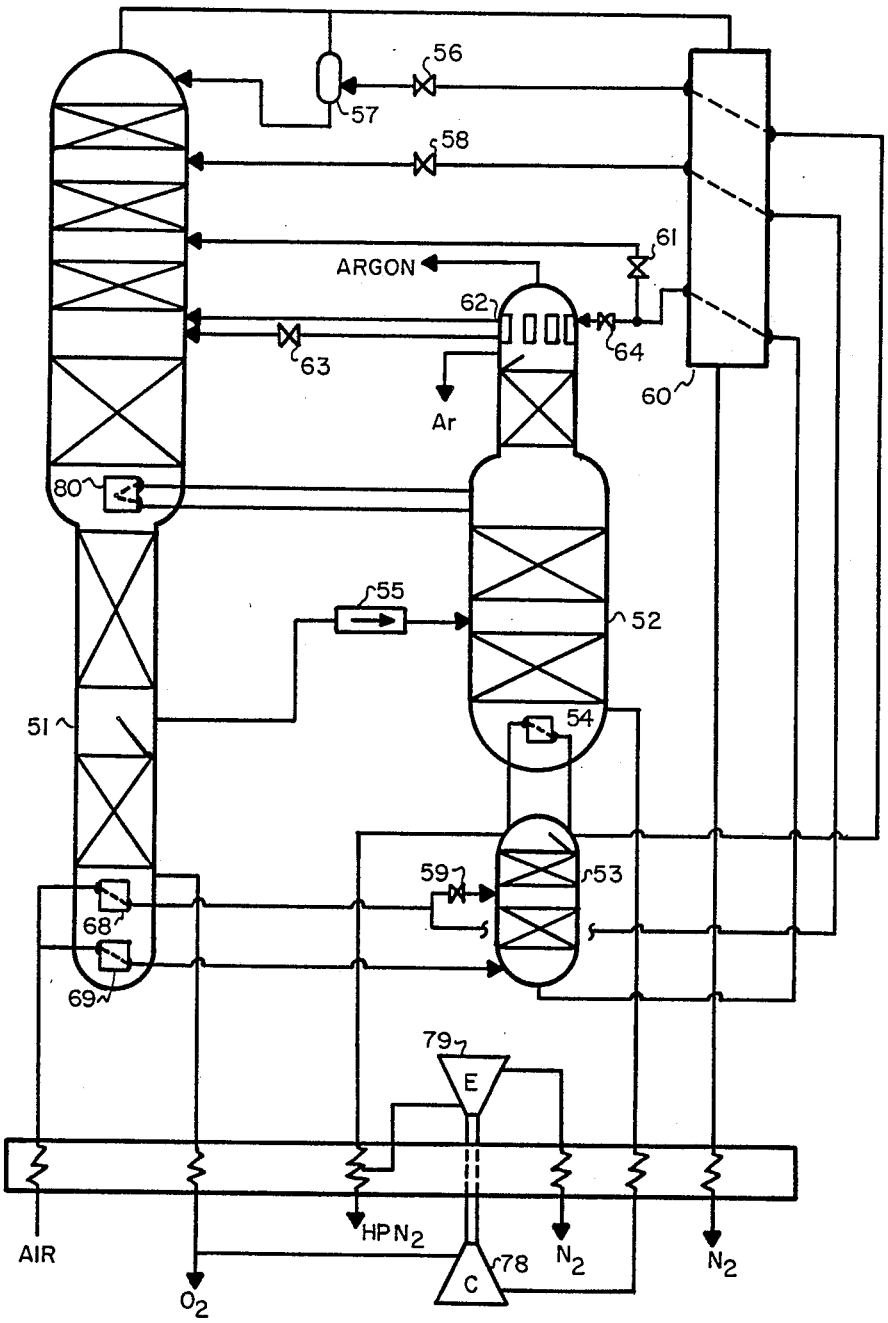
Figure 6:
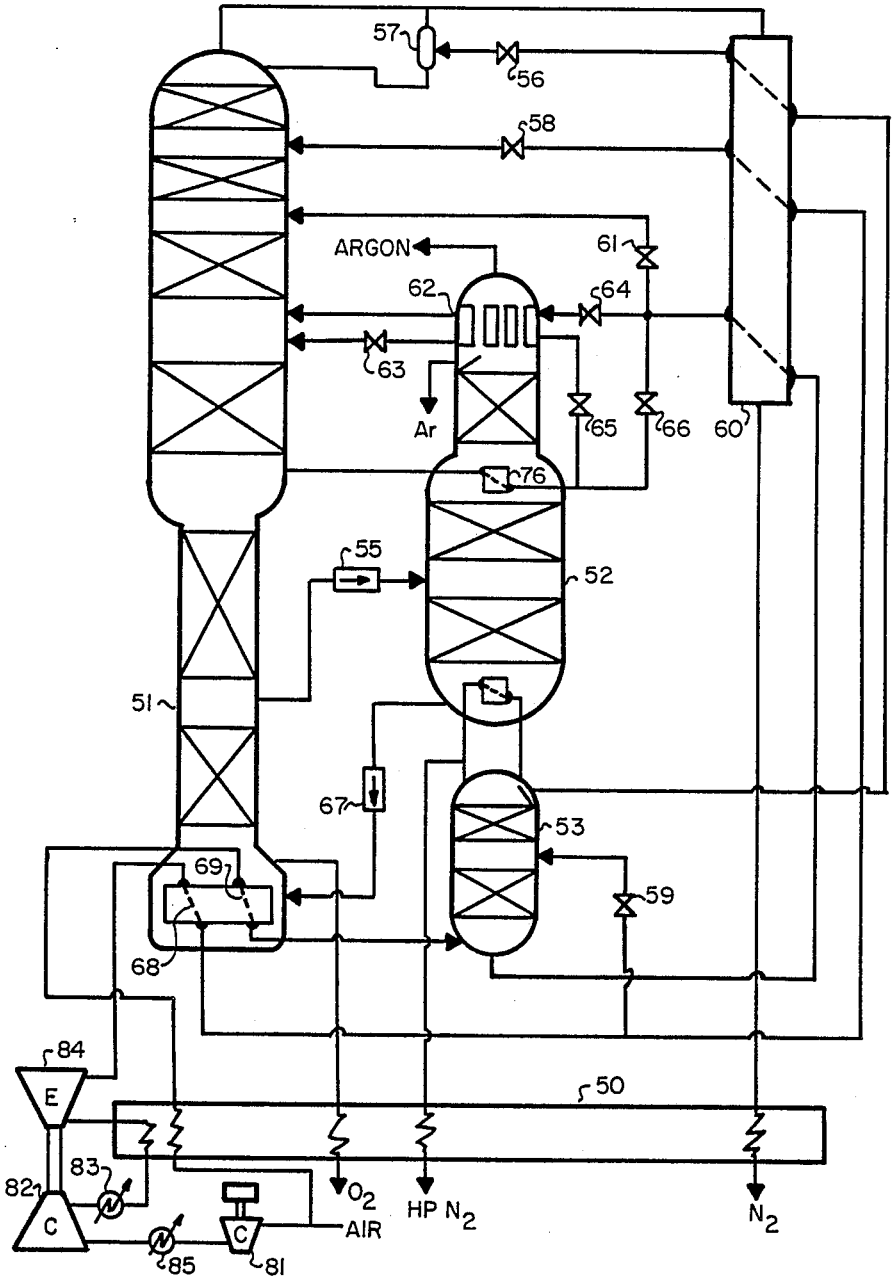

As with FIGS. 1 to 3, other refrigeration options and argon reflux options are also possible in the triple pressure embodiment of this invention as illustrated in FIGS. 5 and 6. Referring to FIG. 5, the intermediate height of the argon rectifier 52 is refluxed by exchange of latent heat with column 51 intermediate reflux height liquid. Refrigeration is via expansion of rectifier 53 overhead vapor to exhaust pressure. Column 52 bottom product is evaporated by reflux condenser 54, then warmed to near ambient temperature and warm-compressed by compressor 78. Thus the LOX evaporation load on partial condenser 69 is considerably reduced—it only evaporates the column 51 bottom product plus a fraction of the column 51 reboil.

FIG. 6 illustrates the refrigeration option which would be used in the triple pressure embodiment of this invention when a substantial quantity of $N_2$ coproduct, up to about 14% of the supply air flowrate, is desired at pressure. As with FIG. 3, the key is to discharge the expanded air at about supply pressure. The air to be totally condensed is additionally compressed at least in externally powered compressor 81, and preferably also in warm compressor 82, including associated optional coolers 85 and 83. After partial deep cooling it is work expanded in expander 84 and then supplied to total condenser 68, preferably at about 0.3 ATA above rectifier 53 pressure. This makes its condensation temperature better match that of partial condenser 69. The two air condensers 68 and69 are shown combined in a single core which is mounted in the sump of column 51, which entails somewhat lower construction cost than the configuration of FIG. 4. Other features are the same as that figure. With both FIGS. 3 and 6, the withdrawal of a substantial quantity of HP rectifier $N_2$ reduces the size of the LP $N_2$ rectifier. Clearly an additional coproduct $N_2$ rectification section could be added at the top of rectifier 53 if desired.

All flowrates and percentages signify molar quantities unless otherwise stipulated.

I claim:

1. A process for the fractional distillation of a supply of compressed and cleaned air to high purity oxygen and crude argon comprising:

(a) distilling an oxygen-argon mixture to liquid oxygen bottom product and crude argon overhead product in an argon-oxygen distillation column comprised of an argon stripper and an argon rectifier;

(b) pressurizing said liquid oxygen bottom product to at least about 0.2 ATA above argon stripper bottom pressure;

(c) evaporating at least part of said pressurized liquid oxygen by exchanging latent heat in a first oxygen evaporator with a major fraction of said supply air which is partially condensed thereby;

(d) withdrawing at least part of said evaporated oxygen as product;

(e) supplying at least the uncondensed fraction of the air from said first oxygen evaporator to a high pressure (HP) rectifier, and rectifying it therein to $N_2$ overhead product and oxygen-enriched bottom product;

(f) refluxing the overhead of said HP rectifier and reboiling the bottom of said argon stripper by exchanging latent heat;

(g) refluxing the overhead of a nitrogen ($N_2$) removal column for distilling said HP rectifier bottom product to oxygen-argon mixture, at least part of which is supplied to said distilling step a), by supplying it with depressurized liquid $N_2$ from the overhead of said HP rectifier;

(h) evaporating additional liquid oxygen in a second oxygen evaporator by exchanging latent heat with about 10 to 20% of said supply air and thereby producing liquid air; and (i) splitting said liquid air into respective intermediate height reflux streams for both said HP rectifier and said $N_2$ removal column.

2. Process according to claim 1 further comprising withdrawing coproduct $N_2$ from said HP rectifier overhead in an amount equal to at least about 2% of said supply air flowrate.

3. Process according to claim 1 further comprised of:

(a) connecting the bottom of said $N_2$ removal column in vapor-liquid communication with the feed height of said argon-oxygen distillation column; and (b) also supplying said second liquid oxygen evaporator with pressurized bottom liquid from said argon stripper.

4. Process according to claim 3 further comprising:

(a) supplying at least part of said depressurized HP rectifier bottom liquid to partial evaporation in an overhead reflux condenser for said argon rectifier;

(b) supplying at least part of the remaining unevaporated liquid portion of said partially evaporated HP rectifier bottom liquid to an intermediate height reflux condenser for said argon rectifier; and (c) feeding at least the vapor components from steps (a) and (b) above to separate feed heights of said nitrogen removal column.

5. Process according to claim 3 comprising refluxing an intermediate height of said argon rectifier by exchanging latent heat between argon rectifier intermediate height vapor and at least one of :

(a) intermediate reboil height liquid from said $N_2$ removal column; and (b) partially depressurized liquid $N_2$ overhead product from said HP rectifier.

6. Process according to claim 3 further comprised of additionally compressing to above supply pressure said 10 to 20% of air enroute to said second evaporator by least one of an externally powered compressor and a compressor powered by a refrigeration expander.

7. Process according to claim 1 further comprising:
(a) connecting a second argon stripper to the bottom of said $N_2$ removal column in direct vapor-liquid communication; and
(b) providing at least part of the reboil for said second argon stripper from said first oxygen evaporator.

8. Process according to claim 7 further comprising providing intermediate height reflux to said argonoxygen distillation column by exchanging latent heat between argon-oxygen column intermediate reflux height vapor and at least one of:
(a) nitrogen removal column intermediate reboil height liquid; and
(b) an unevaporated liquid portion withdrawn from an overhead reflux condenser for said argon-oxygen distillation column which is supplied at least part of said depressurized kettle liquid.

9. Process according to claim 7 further comprising additionally compressing while warm a minor fraction (about 6 to 13%) of said supply air; partially cooling said additionally compressed air; work expanding said additionally compressed air to the approximate pressure of said $N_2$ removal column; and powering said warm compression by said work expansion.

10. Process according to claim 7 further comprising additionally compressing while warm said minor fraction of supply air to be totally condensed; partially cooling and work-expanding said additionally compressed air prior to said total condensation latent heat exchange; and powering said additional compression by at least one of said expansion work and an external power supply.

11. Process according to claim 7 further comprising providing at least part of the liquid oxygen for said second evaporator from said second argon stripper.

12. A process for the cryogenic distillative separation of a supply of compressed and cleaned air into at least high purity oxygen comprising:
(a) stripping argon from a liquid oxygen-argon mixture in at least one argon stripper operating near atmospheric pressure;
(b) evaporating the liquid oxygen bottom product from said at least one argon stripper by exchanging latent heat with three different condensing gases:
(i) about 10 to 20 percent of the supply air which is essentially totally condensed thereby;
(ii) at least the majority of the remaining supply air which is partially condensed thereby; and
(iii) nitrogen from the overhead of a high pressure rectifier;
(c) supplying at least the uncondensed portion of said partially condensed supply air to said HP rectifier, and rectifying it into said overhead nitrogen and a oxygen-enriched bottom liquid;
(d) distilling said bottom liquid into said oxygen-argon mixture and low pressure nitrogen in a low pressure nitrogen removal column; and
(e) supplying approximately half of the liquid air from step (b)(i) to an intermediate reflux height of said HP rectifier and essentially all of the remainder to an intermediate reflux height of said low pressure nitrogen removal column.

13. Apparatus designed, adapted, and dimensioned for cryogenic distillative separation of cleaned and compressed supply air into at least high purity oxygen comprising:
(a) a high pressure rectifier;
(b) a nitrogen removal column which incorporates an argon-oxygen stripper at the bottom;
(c) a first latent heat exchanger for evaporating liquid oxygen, said first latent heat exchanger designed to receive and essentially totally condense between about 10 to 20% of said supply air;
(d) a means for splitting the liquid air from said first latent heat exchanger into two streams for respective supply to intermediate reflux heights of said HP rectifier and said $N_2$ removal column;
(e) a second latent heat exchanger for evaporating liquid oxygen obtained at least partly from said argon stripper by exchanging latent heat with a major fraction of said supply air which is partially condensed thereby;
(f) a means for routing at least the uncondensed portion of the air leaving said second latent heat exchanger to said HP rectifier; and
(g) a means for supplying depressurized liquid nitrogen separation product from said HP rectifier to said $N_2$ removal column as overhead reflux therefor.

14. Apparatus according to claim 13 further comprised of:
(a) a reboiler/reflux condenser for exchanging latent heat between HP rectifier overhead vapor and argon stripper bottom liquid oxygen
(b) an argon rectifier sidearm which connects to and is in vapor-liquid communication with the juncture between said argon stripper and said $N_2$ removal column; and
(c) a means for pressurizing the liquid oxygen supplied to said first and second latent heat exchangers to at least 0.2 ATA above the argon stripper bottom pressure.

15. Apparatus according to claim 14 further comprised of at least one intermediate height reflux condenser for said argon rectifier which exchanges latent heat with at least one of
(a) $N_2$ removal column intermediate reflux height liquid;
(b) partially depressurized liquid $N_2$ overhead product from said HP rectifier; and
(c) unevaporated liquid from an overhead reflux condenser for said argon rectifier, said reflux condenser including a means for supplying depressurized HP rectifier bottom liquid thereto for partial evaporation therein.

16. Apparatus according to claim 13 further comprised of:
(a) an argon-oxygen distillation column which includes a second argon-oxygen stripper as the bottom portion of said column;
(b) a means for feeding liquid oxygen-argon mixture from the connection point of said $N_2$ removal column and said first argon-oxygen stripper to said argon-oxygen distillation column;
(c) a reboiler/reflux condenser for exchanging latent heat between HP rectifier overhead vapor and argon-oxygen distillation column bottom liquid;
(d) a means for pressurizing the liquid oxygen bottom product from said argon-oxygen distillation column to at least 0.2 ATA above column bottom pressure and supplying it to to at least one of said first and second latent heat exchangers; and (e) a means for routing part of the evaporated oxygen from said second latent heat exchanger to said first argon-oxygen rectifier as bottoms reboil therefor, and for withdrawing the remaining evaporated oxygen from said second latent heat exchanger as product.

17. Apparatus according to claim 16 further comprised of at least one intermediate height reflux condenser for said argon-oxygen distillation column which exchanges latent heat with at least one of:

(a) $N_2$ removal column intermediate reboil height liquid; and (b) unevaporated liquid from an overhead reflux condenser for said argon-oxygen distillation column, said reflux condenser including a means for supplying depressurized HP rectifier bottom liquid thereto.

18. Process for distillative separation of a supply of compressed and cleaned air into high purity oxygen and crude argon comprising:

(a) rectifying at least the uncondensed portion of at least a major fraction of said supply air to $N_2$ overhead product and bottom liquid;

(b) reboiling an argon-oxygen stripper which is connected to an argon-oxygen rectifier by exchanging latent heat with HP rectifier overhead $N_2$;

(c) refluxing the overhead of said argon-oxygen rectifier by exchanging latent heat with at least part of the depressurized HP rectifier bottom liquid;

(d) refluxing an intermediate height of said argon-oxygen rectifier by exchanging latent heat with an unevaporated portion of the liquid withdrawn from said overhead refluxing step; and (e) separately feeding at least the vapor components produced by said overhead and intermediate reflux condensers to different heights of a $N_2$ removal column.

19. Process according to claim 18 further comprising:

(a) connecting the bottom of said $N_2$ removal column in vapor-liquid communication with the top of said argon-oxygen stripper and the bottom of said argon-oxygen rectifier;

(b) pressurizing the liquid oxygen bottom product from said argon-oxygen stripper to at least 0.2 ATA above stripper bottom pressure;

(c) evaporating said liquid oxygen to product in two separate latent heat exchangers:

(i) one in which about 10 to 20 percent of said supply air is totally condensed; and (ii) the other in which at least the majority of the remaining supply air is partially condensed;

(d) supplying between 25 and 75% of the liquid air from step (c)(i) to each of:

(i) an intermediate reflux height of said $N_2$ removal column; and (ii) an intermediate reflux height of said HP rectifier; and (e) supplying at least the uncondensed portion of the air from step (c)(ii) to said HP rectifier.

20. Process according to claim 18 further comprising:

(a) providing a second argon-oxygen stripper, which is connected to the bottom of said $N_2$ removal column;

(b) feeding liquid oxygen-argon mixture from the connecting point of said second stripper and $N_2$ removal column to the connecting point of said first stripper and argon-oxygen rectifier;

(c) pressurizing the liquid oxygen bottom product from said first stripper to at least the bottom pressure of said second stripper which is at least 0.2 ATA above the bottom pressure of said first stripper;

(d) evaporating the bottom liquid oxygen from said second stripper and the pressurized bottom liquid oxygen from said first stripper in at least two separate latent heat exchangers;

(i) one in which about 10 to 20% of said supply air is totally condensed; and (ii) the other in which at least the majority of the remaining supply air is partially condensed;

(e) supplying between 25% and 75% of the liquid air from step (d)(i) to each of:

(i) an intermediate reflux height of said $N_2$ removal column; and (ii) an intermediate reflux height of said HP rectifier; and (f) supplying at least part of the evaporated oxygen from said partial condensation latent heat exchanger as bottom reboil to said second argon stripper, and withdrawing the remainder as product.

21. Apparatus for fractional distillation of a supply of compressed and cleaned air to high purity oxygen and crude argon comprising:

(a) a high pressure rectifier;

(b) an argon distillation column comprised of an argon stripper and an argon rectifier;

(c) a reboiler/reflux condenser for exchanging latent heat between said HP rectifier overhead $N_2$ and argon stripper bottom liquid oxygen;

(d) an overhead reflux condenser for said argon rectifier which is supplied depressurized HP rectifier bottom liquid for partial evaporation therein; and (e) an intermediate height reflux condenser for said argon rectifier which is supplied at least part of the unevaporated liquid from said overhead reflux condenser.

22. Apparatus according to claim 21 further comprised of:

(a) a first latent heat exchanger for evaporating liquid oxygen in which approximately 10 to 20 percent of the supply air is condensed to liquid air;

(b) a second latent heat exchanger for evaporating liquid oxygen at least partly obtained from said argon stripper bottoms by exchanging latent heat with a major fraction of said supply air which is partially condensed thereby;

(c) a means for withdrawing at least part of the evaporated oxygen from said second latent heat exchanger as product;

(d) a means for splitting said liquid air into two intermediate height reflux streams for respectively said HP rectifier and a $N_2$ removal column which is overhead refluxed by HP rectifier overhead liquid.

* * * * *